US010301902B2

(12) United States Patent
Tuckness et al.

(10) Patent No.: US 10,301,902 B2
(45) Date of Patent: May 28, 2019

(54) ANTI-PRESET AND ANTI-RESET FEATURE FOR RETRIEVABLE PACKERS WITH SLIPS ABOVE ELEMENTS

(71) Applicant: Halliburton Energy Services, Inc., Houston, TX (US)

(72) Inventors: Cynthia S. Tuckness, Coppell, TX (US); James W. Scott, Highland Village, TX (US); Michael D. Ezell, Carrollton, TX (US)

(73) Assignee: Halliburotn Energy Services, Inc., Houston, TX (US)

( * ) Notice: Subject to any disclaimer, the term of this patent is extended or adjusted under 35 U.S.C. 154(b) by 330 days.

(21) Appl. No.: 15/102,189

(22) PCT Filed: Dec. 5, 2014

(86) PCT No.: PCT/US2014/068740

§ 371 (c)(1),
(2) Date: Jun. 6, 2016

(87) PCT Pub. No.: WO2016/089417

PCT Pub. Date: Jun. 9, 2016

(65) Prior Publication Data

US 2016/0356117 A1 Dec. 8, 2016

(51) Int. Cl.
*E21B 23/01* (2006.01)
*E21B 29/00* (2006.01)
(Continued)

(52) U.S. Cl.
CPC ..... *E21B 33/1293* (2013.01); *E21B 23/01* (2013.01); *E21B 23/06* (2013.01); *E21B 29/002* (2013.01)

(58) Field of Classification Search
CPC ..... E21B 33/1295; E21B 23/01; E21B 23/06; E21B 29/002; E21B 33/1293
See application file for complete search history.

(56) References Cited

U.S. PATENT DOCUMENTS 4,284,137 A 8/1981 Taylor
6,378,606 B1 4/2002 Swor et al.
(Continued)

FOREIGN PATENT DOCUMENTS

WO 02/090710 A2 11/2002
WO 2014/077800 A1 5/2014

OTHER PUBLICATIONS

International Preliminary Report on Patentability issued in related Application No. PCT/US2014/068740, dated Jun. 15, 2017 (11 pages).
(Continued)

*Primary Examiner* — Daniel P Stephenson
(74) *Attorney, Agent, or Firm* — Scott Richardson; Baker Botts L.L.P.

(57) ABSTRACT

Apparatuses and methods for an anti-preset and anti-reset mechanism for a retrievable packer are disclosed herein. These features may be used to prevent the packer from being actuated prematurely during deployment downhole and to prevent the packer from re-actuating during retrieval. An apparatus may include a mandrel, a slip assembly disposed about the mandrel, a collet member disposed about the mandrel and adjacent to the slip assembly, and a cover sleeve disposed about the mandrel and coupled to the collet member. A method for releasing a packer may include cutting a mandrel, sliding a cover sleeve and a collet member having a collet lug downhole with respect to the mandrel, applying force from the collet member to the slip assembly, disengaging the slip assembly from a well casing, and engaging an inner surface of the collet lug to a protrusion on the mandrel.

19 Claims, 9 Drawing Sheets

(51) Int. Cl.
*E21B 33/129* (2006.01)
*E21B 23/06* (2006.01)

(56) References Cited

U.S. PATENT DOCUMENTS 6,481,496 B1* 11/2002 Jackson ..... E21B 33/128 166/120
6,691,788 B1 2/2004 Dearing
2002/0121380 A1 9/2002 Doane et al.
2004/0244966 A1 12/2004 Zimmerman et al.
2011/0056676 A1 3/2011 Birner
2012/0160521 A1 6/2012 McGlothen et al.
2013/0048311 A1* 2/2013 Slup ..... E21B 23/01 166/382
2013/0092369 A1* 4/2013 Stingerie ..... E21B 33/0422 166/208
2014/0151025 A1 6/2014 Harms et al.
2016/0168935 A1* 6/2016 Pray ..... E21B 33/1291 166/377
2016/0168938 A1* 6/2016 Pray ..... E21B 23/06 166/377
2016/0273290 A1* 9/2016 Harms ..... E21B 23/02
2016/0356117 A1* 12/2016 Tuckness ..... E21B 23/06
2016/0369582 A1* 12/2016 Bar ..... E21B 23/01
2016/0369585 A1* 12/2016 Limb ..... E21B 33/129
2016/0376869 A1* 12/2016 Rochen ..... E21B 23/06 166/135
2017/0051574 A1* 2/2017 Hughes ..... E21B 33/1216
2017/0130553 A1* 5/2017 Harris ..... E21B 23/01
2017/0292339 A1* 10/2017 Adam ..... E21B 23/01
2018/0106120 A1* 4/2018 Harris ..... E21B 43/26

OTHER PUBLICATIONS

International Search Report and Written Opinion issued in related PCT Application No. PCT/US2014/068740 dated Aug. 3, 2015, 14 pages.
Search Report and Written Opinion issued in related Singapore Patent Application No. 11201703393T dated Jun. 29, 2018, 9 pages.

* cited by examiner

ANTI-PRESET AND ANTI-RESET FEATURE FOR RETRIEVABLE PACKERS WITH SLIPS ABOVE ELEMENTS

CROSS-REFERENCE TO RELATED APPLICATION

The present application is a U.S. National Stage Application of International Application No. PCT/US2014/068740 filed Dec. 5, 2014, which is incorporated herein by reference in its entirety for all purposes.

BACKGROUND

This disclosure relates, in general, to tools and equipment for completing a subterranean well and, in particular, to a retrievable well packer for sealing the annulus between a tubing string and the well casing. In particular, this disclosure relates to an anti-preset and anti-reset mechanism for a retrievable packer to prevent the packer from being actuated prematurely during deployment downhole and also to prevent the packer from undesirably re-actuating during retrieval.

BRIEF DESCRIPTION OF THE DRAWINGS

These drawings illustrate certain aspects of certain embodiments of the present disclosure. They should not be used to limit or define the disclosure.

Figure 1:
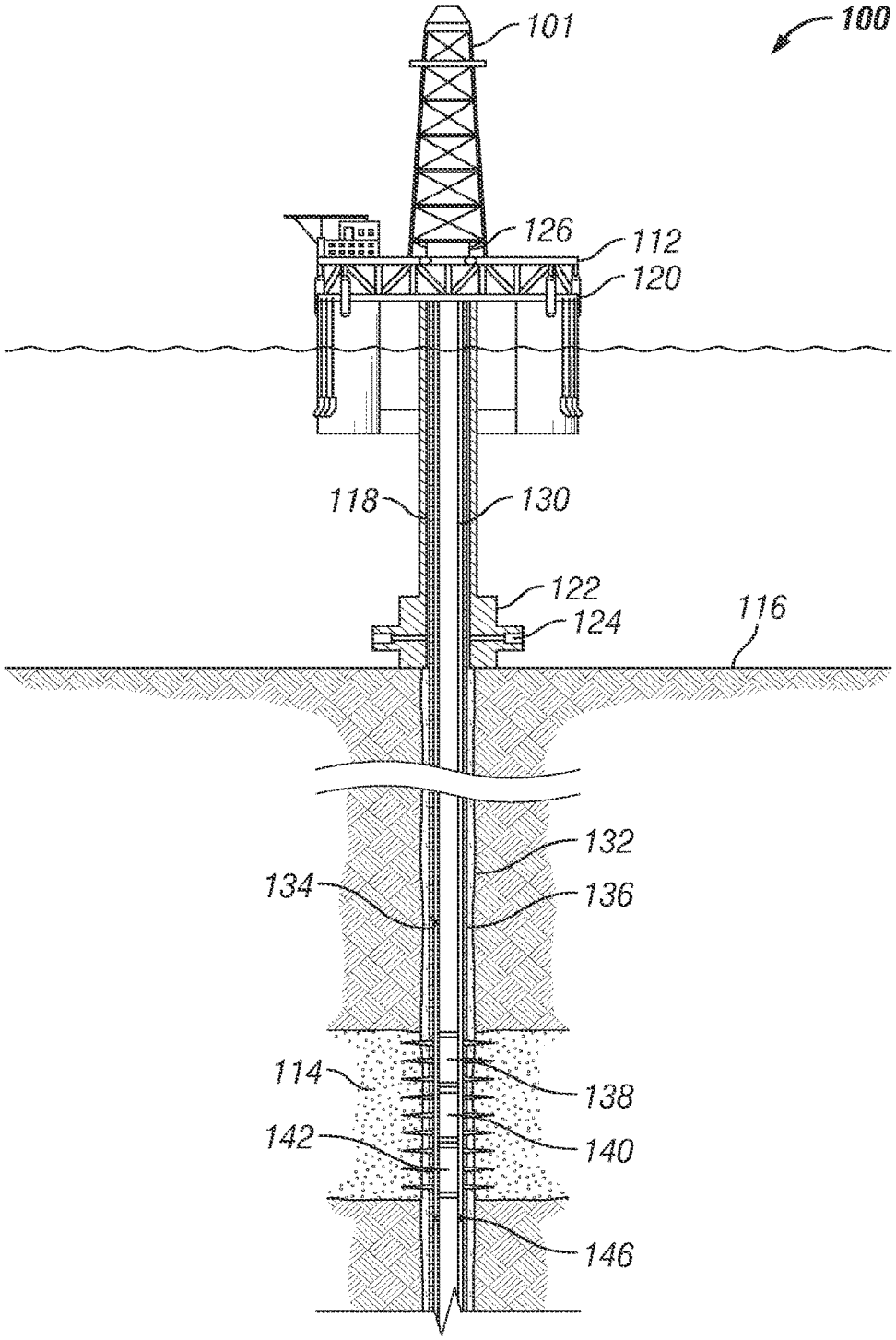
FIG. 1 depicts a hydrocarbon production site in accordance with one embodiment of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory ("RAM"), one or more processing resources such as a central processing unit ("CPU") or hardware or software control logic, ROM, and/or other types of nonvolatile memory. Additional components of the information handling system may include one or more disk drives, one or more network ports for communication with external devices as well as various input and output ("I/O") devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory ("EEPROM"), and/or flash memory; as well as communications media such as wires.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the wellbore below), or otherwise nonlinear wellbores in any type of subterranean formation. Certain embodiments may be applicable, for example, to logging data acquired with wireline, slickline, and logging-while-drilling/measurement-while-drilling (LWD/MWD). Certain embodiments may be applicable to subsea and/or deep sea wellbores. Embodiments described below with respect to one implementation are not intended to be limiting.

This disclosure relates to an anti-preset mechanism for deploying a downhole tool to a desired location and for preventing premature actuation of the tool during insertion thereof into a subterranean wellbore. Further, this disclosure relates to an anti-reset mechanism for retrieving a downhole tool from a wellbore and from preventing undesired re-actuating of the tool during retrieval thereof from the wellbore.

FIG. 1 illustrates an example completion system 100 according to aspects of the present disclosure. The completion system 100 includes a semi-submersible platform 112, centered over a submerged formation 114 located below sea floor 116. A subsea conduit 118 extends from a deck 120 of the platform 112 to a wellhead installation 122 including blowout preventers 124. Platform 112 has a hoisting apparatus 126 and a derrick 101 for raising and lowering pipe strings such as work string 130.

A wellbore 132 extends through the various earth strata including formation 114. A casing 134 is cemented within wellbore 132 by cement 136. Work string 130 includes various tools including sand control screens 138, 140, 142 positioned in an interval of wellbore 132 adjacent to formation 114 above retrievable packer 146 of the present invention.

Although the embodiment in FIG. 1 depicts a vertical well, it should be noted by one skilled in the art that the retrievable packers of the present invention are equally well-suited for use in deviated wells, inclined wells or horizontal wells. Also, even though FIG. 1 depicts an offshore operation, it should be noted by one skilled in the art that the retrievable packers of the present invention are equally well-suited for use in onshore operations.

Figure 2A:
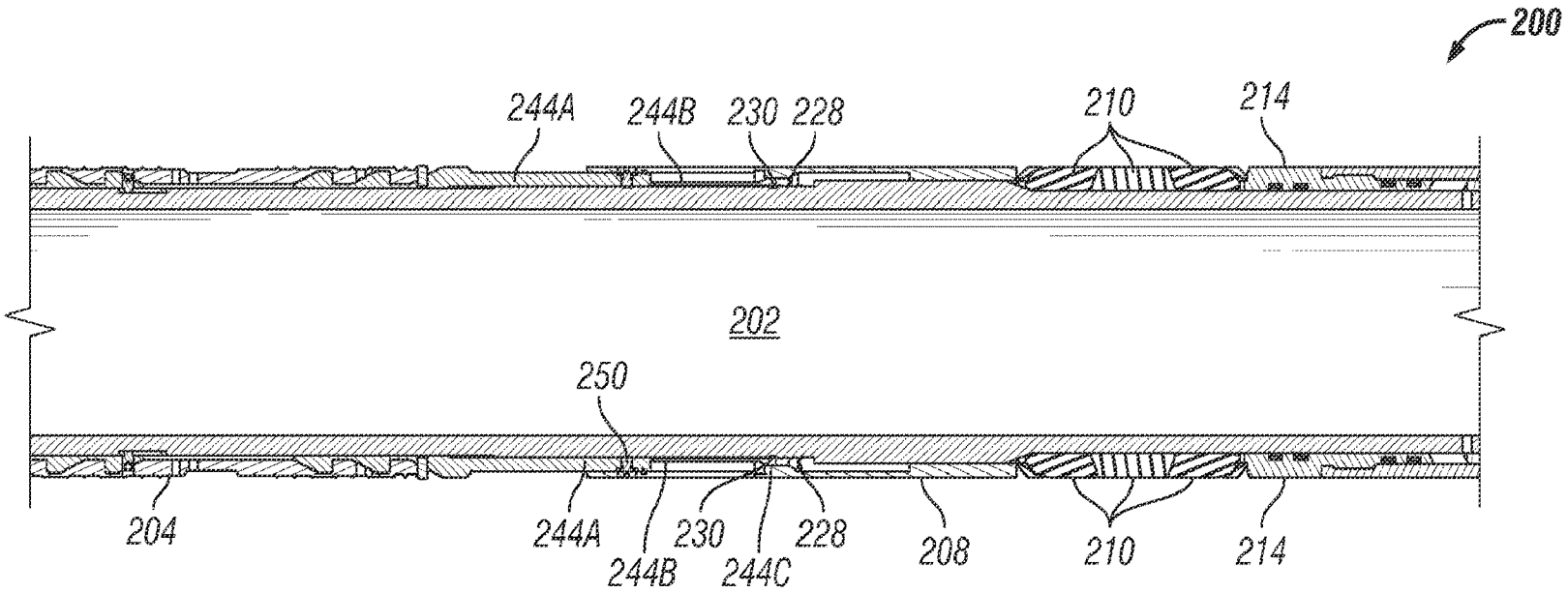
FIGS. 2A-2C depict an exemplary packer assembly shown in a run configuration in accordance with one embodiment of the present disclosure.
Figure 2B:
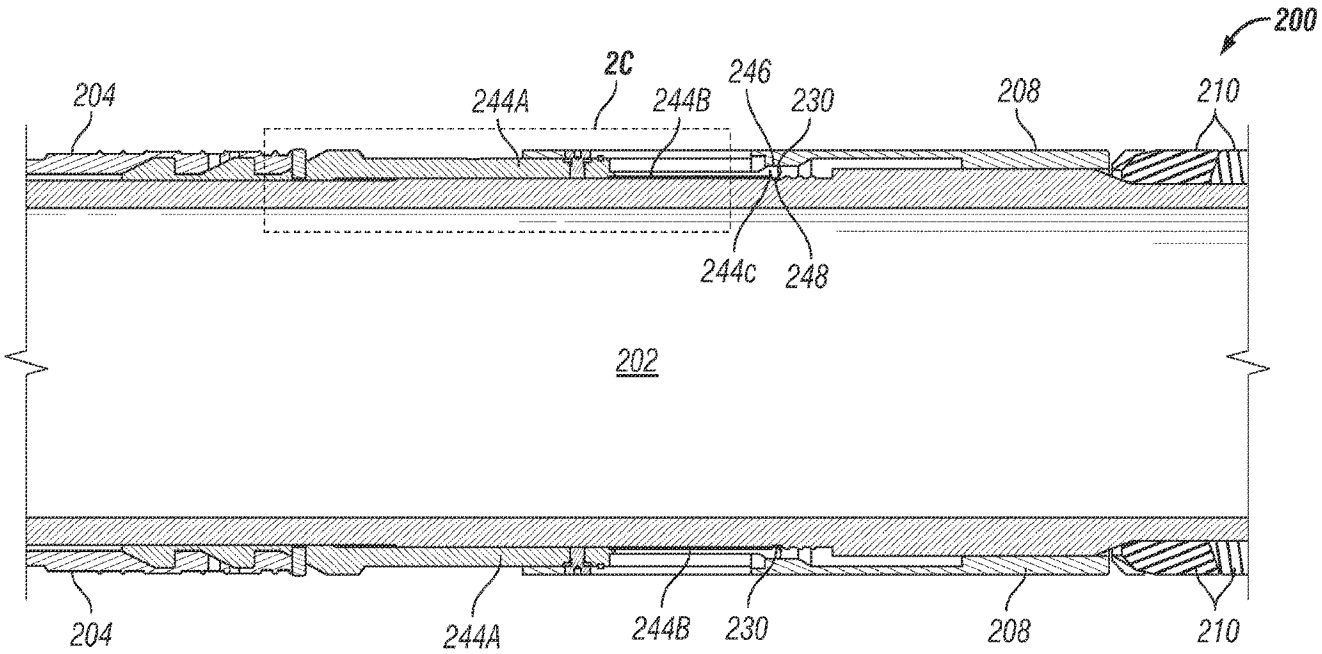
Figure 2C:
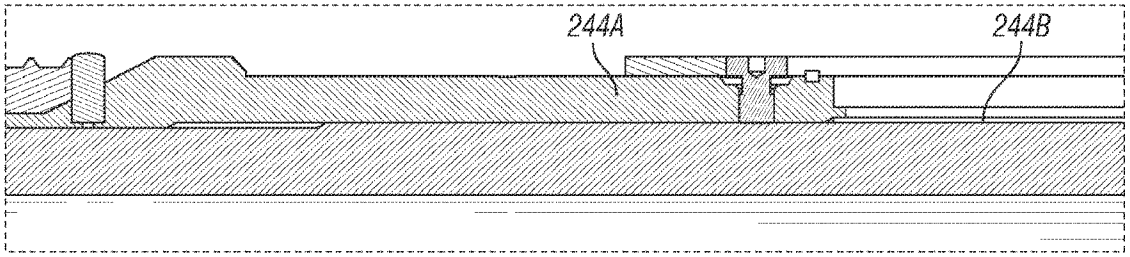

Referring now to FIGS. 2A-2C, a packer assembly is shown in a run position and is generally marked 200. An operator may couple the packer assembly 200 in this configuration to tubing string (not shown) in order to run the packer assembly 200 downhole. The packer assembly 200 may be retrievable.

Still referring to FIGS. 2A-2C, the packer assembly 200 may include a substantially tubular, longitudinally extending mandrel 202 having a substantially cylindrical hollow interior defining a longitudinal production flow passageway. The mandrel 202 may have one or more protrusions 228 on an outer surface and one or more depressions 230 on an outer surface. The protrusions 228 may include, for example, a ridge or a bump but is not intended to be so limited. The depression may include, for example, a groove, but is not intended to be so limited. In some embodiments, the protrusions 228 may be replaced with a shoulder or a locking profile (not shown) that also may allow the collet member 244A to secure in place. The packer assembly 200 may further include a slip assembly 204, which may be disposed about the mandrel 202. The slip assembly 204 may be operable to move radially about the mandrel 202. The packer assembly 200 may further include a collet member 244A with a lower wedge, which may be disposed about the mandrel 202 and may be coupled to the slip assembly 204. The collet member 244A may be operable to slide uphole or downhole with respect to the mandrel 202 and may be selectively moveable to run, set, and release positions along the length of the mandrel 202. In the embodiment shown in FIGS. 2A, 2B, and 2C the collet member 244A includes the lower wedge. Thus, the collet member 244A and the lower wedge may move together as one element. In other embodiments, the lower wedge and the collet member 244A may be two separate elements that may be coupled by threading, by a screw, or by any other coupling means.

Still referring to FIGS. 2A-2C, the collet member 244A may include one or more collet fingers 244B. The collet member 244A may have a variety of configurations including configurations having other numbers of collet fingers 244B. One or more of the collet fingers 244B may include a tapered inner surface 248 and a tapered outer surface 246 that together may comprise a collet lug 244C. The collet member 244A may be coupled to a cover sleeve 208 by a cap screw (not shown) or by any other mechanical coupling. The slip assembly 204 may be located uphole of the collet member 244A and the cover sleeve 208. FIG. 2C shows a close-up view of the collet member 244A and collet fingers 244B.

Figure 3A:
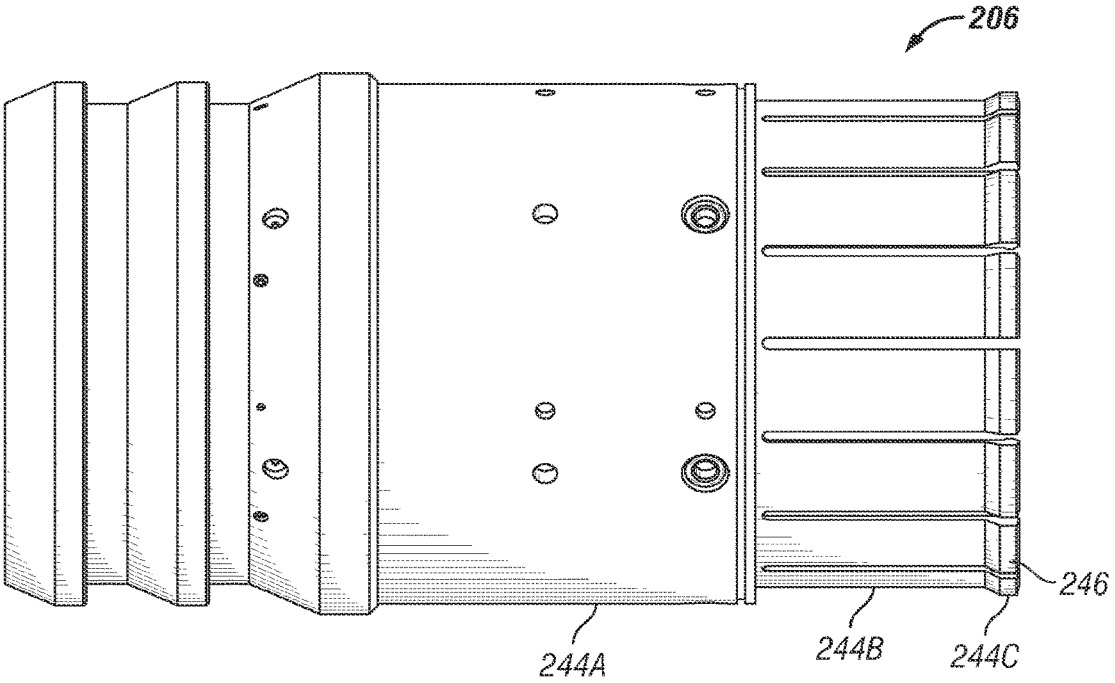
FIG. 3A depicts a side view of a collet member in accordance with one embodiment of the present disclosure.
Figure 3B:
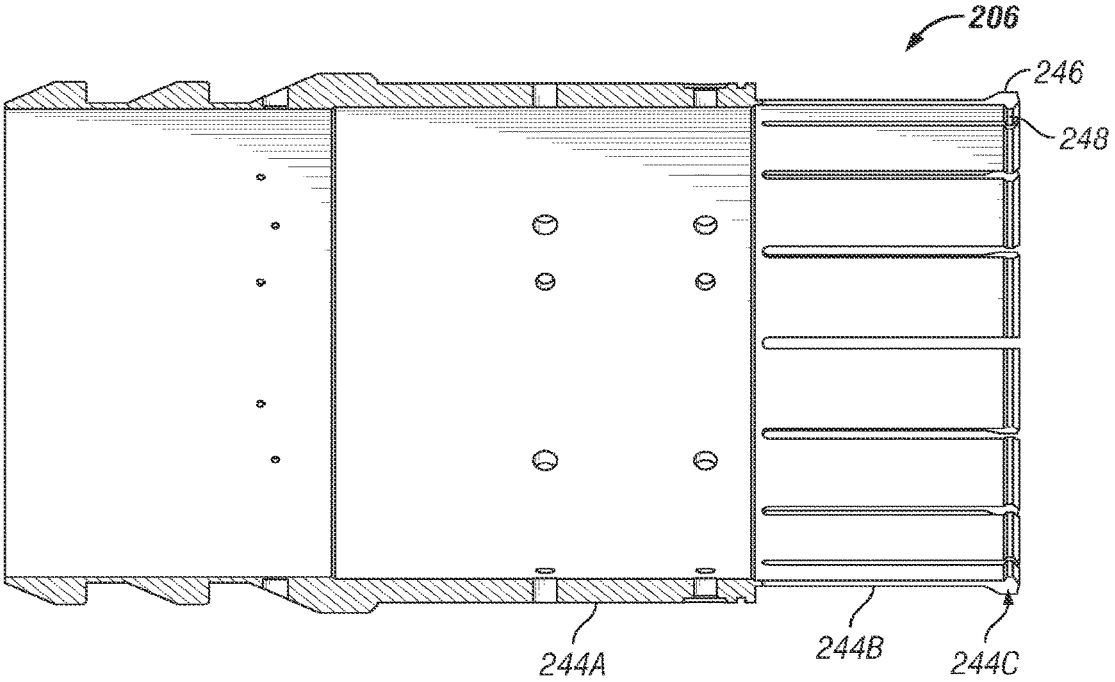
FIG. 3B depicts a cross-sectional view of a collet member in accordance with one embodiment of the present disclosure

The collet member 244A is shown in further detail in FIGS. 3A and 3B. FIG. 3A shows the collet member 244A in a planar view while FIG. 3B shows the collet member 244A in a cross-sectional view. An inner surface 248 of the collet lug 244C (shown in FIGS. 3A and 3B) may engage a depression 230 (shown in FIG. 4B) in the run position to prevent premature actuating of the packer assembly 200. In this way, when the packer assembly 200 is deployed downhole, the packer is prevented from prematurely actuating. In the run position shown in FIGS. 2A and 2B, the collet lugs 244C are covered by the cover sleeve 208.

Figure 4A:
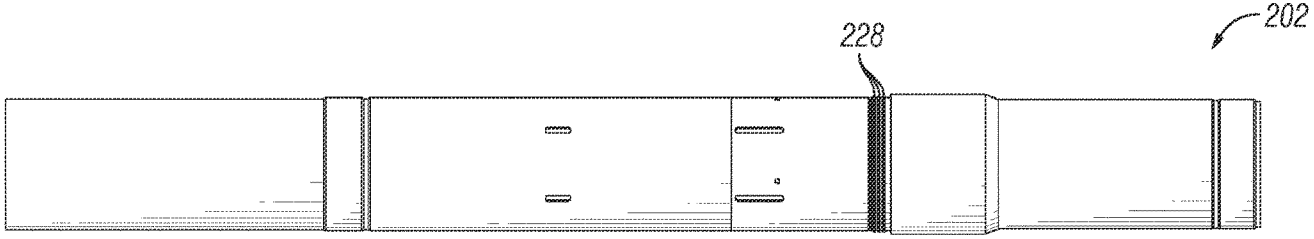
FIGS. 4A and 4B depict a mandrel in accordance with one embodiment of the present disclosure.
Figure 4B:
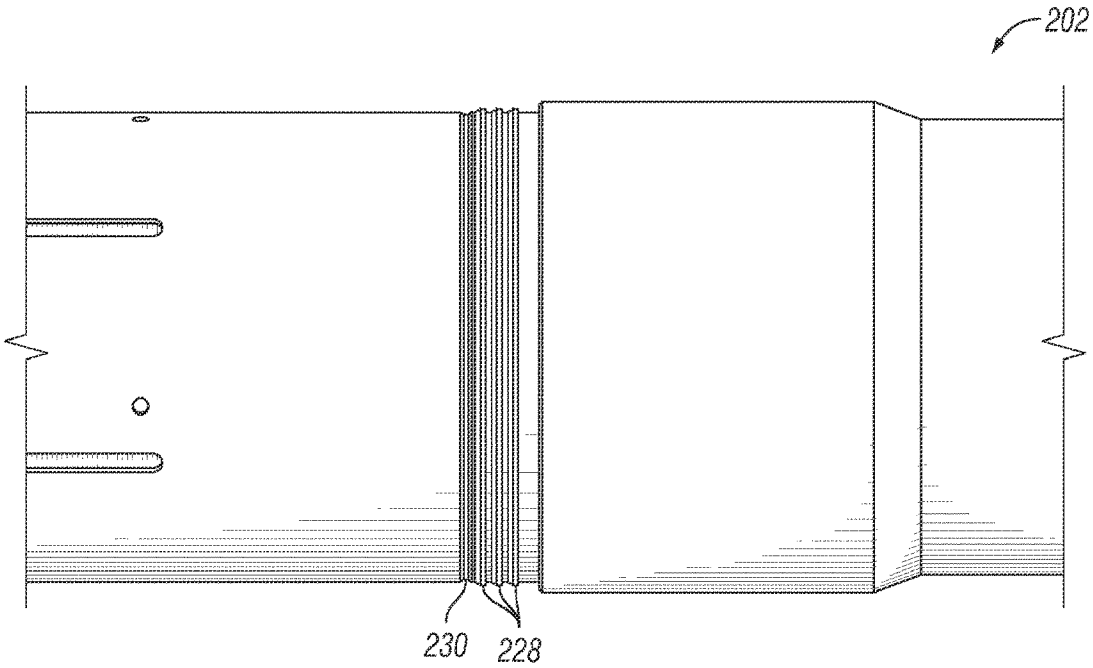

The mandrel 202 is shown in further detail in FIGS. 4A and 4B. The mandrel 202 may have a depression 230 and one or more protrusions 228 on its outer surface. The depression 230 may be a recessed groove. As discussed above, an inner surface 248 of the collet lug 244C (shown in FIGS. 3A and 3B) may engage the depression 230 in the run position to prevent premature actuating of the packer assembly 200.

Figure 5A:
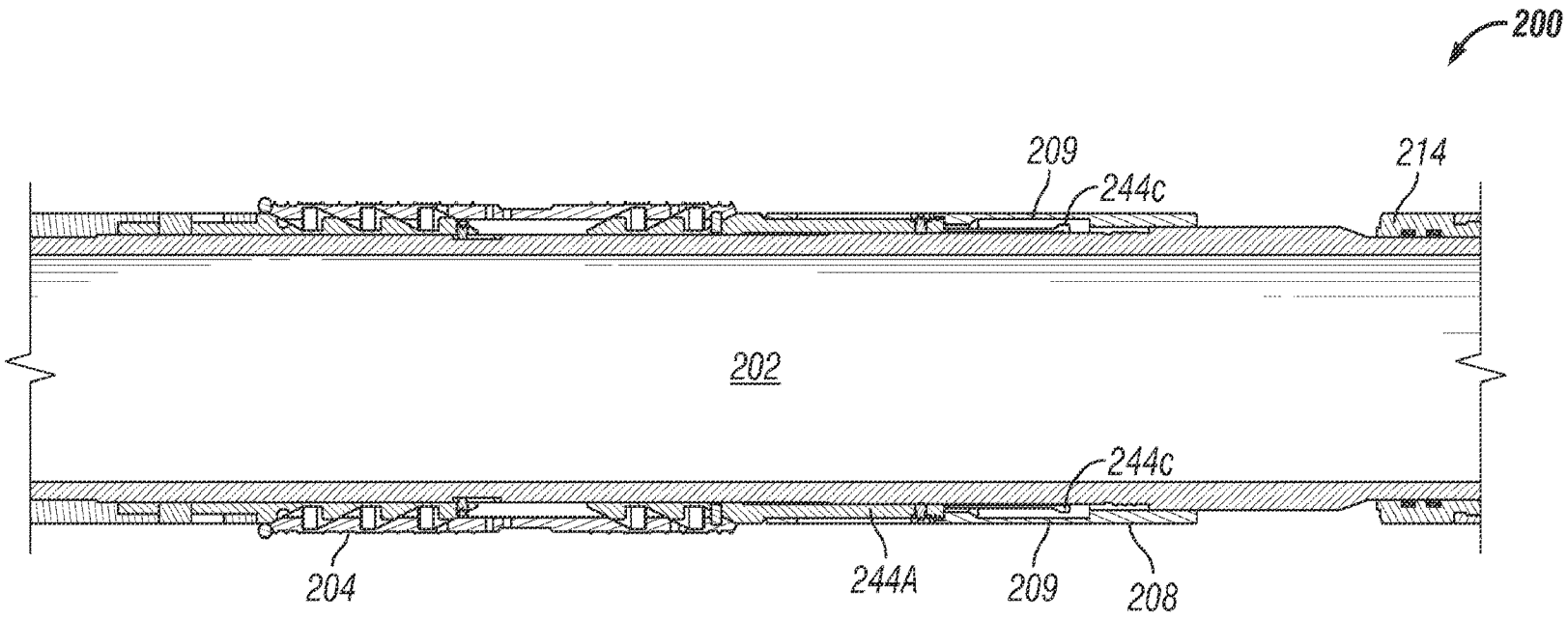
FIGS. 5A and 5B depict an exemplary packer assembly shown in a set configuration in accordance with one embodiment of the present disclosure.
Figure 5B:
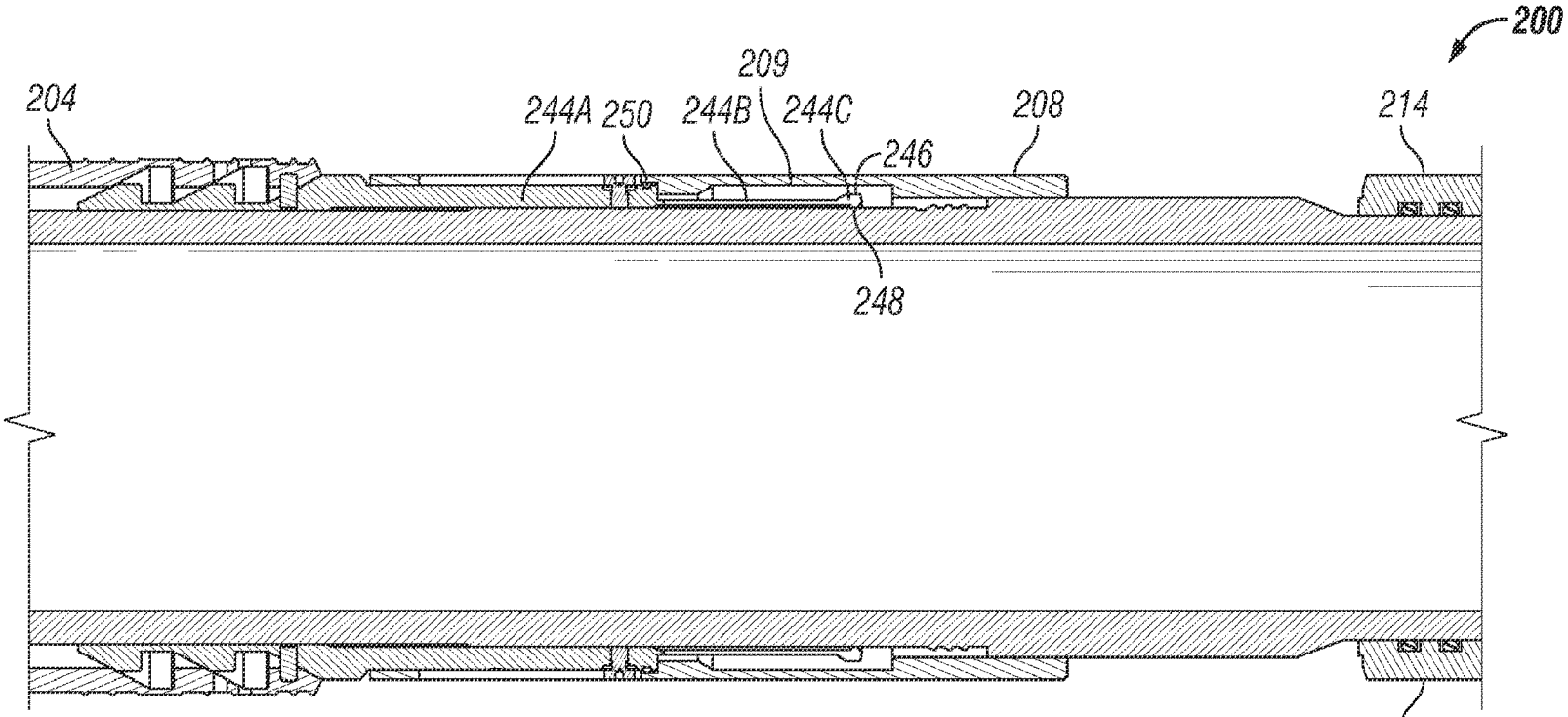

Referring now to FIGS. 5A and 5B, the packer assembly 200 is shown in a set position. Once the packer assembly 200 is attached to a tubing string (not shown), the packer assembly 200 may be run downhole and located in the desired position within the casing 134 (shown in FIG. 1). When the operator wants to seal the annulus (not shown), the operator may mechanically shift the packer assembly 200 by deploying a setting piston 214. The setting piston 214 may compress the rubber elements (not shown), which may move uphole. This movement may then cause other elements in the packer assembly 200 to move uphole. Specifically, the rubber elements 210 (not shown in FIGS. 5A and 5B) may move upwards and apply force on the cover sleeve 208 to move upwards. Then, an undercut 209 in the cover sleeve 208 may release the collet lugs 244C from the depression 230 of the mandrel 202. Thus, the collet lug 244C may move freely and may extend radially. Thus, the collet lug 244C may move uphole with the collet member 244A. Further, a snap ring 250 or any other mechanical means may operate to couple the cover sleeve 208 to the collet member 244A when the packer assembly 200 is in a set position. When the surface of the collet member 244A engages the slip assembly 204, the slip assembly 204 may move radially outward, into gripping engagement with well casing 134 (not shown in FIGS. 5A and 5B). Thus, a gripping and sealing relationship may be established between the packer assembly 200 and the well casing 134 when the slip assembly 204 is deployed into a set position. Once the packer assembly 200 is set within the well casing 134, the packer assembly 200 will provide a seal until it is desired to retrieve the packer assembly 200 from the well.

Figure 6A:
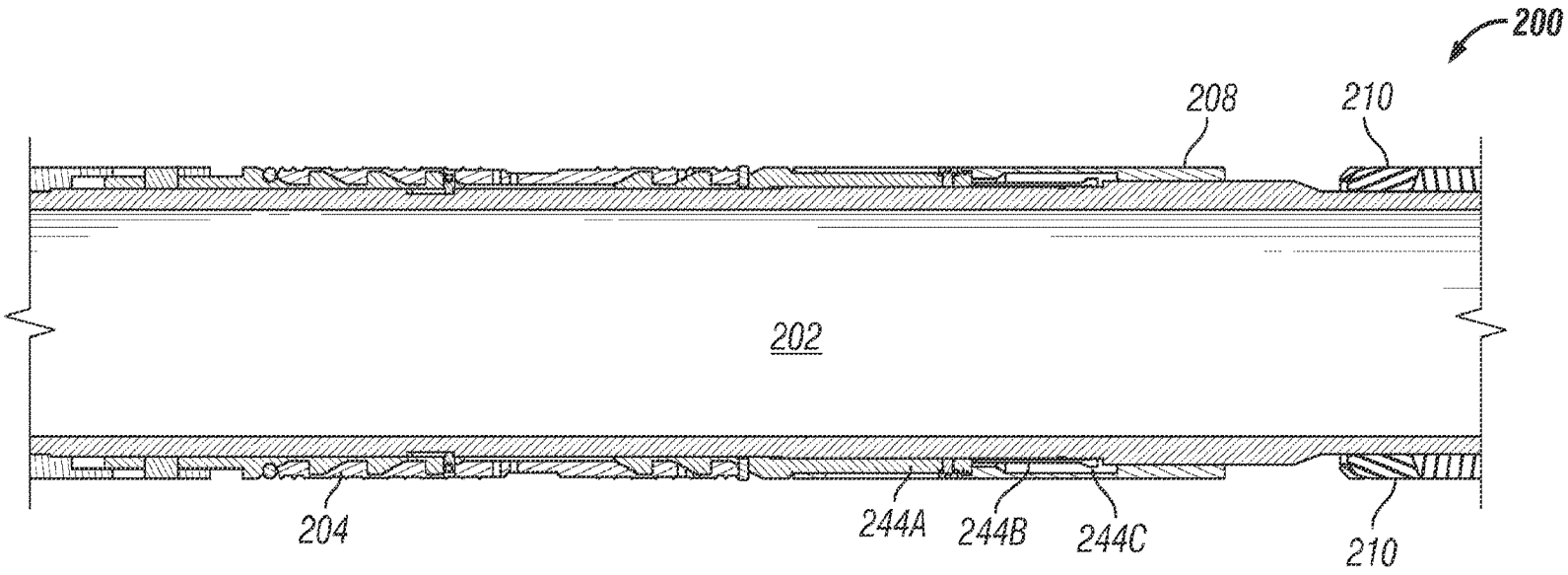
FIGS. 6A-6C depict an exemplary packer assembly shown in a release configuration in accordance with one embodiment of the present disclosure.
Figure 6B:
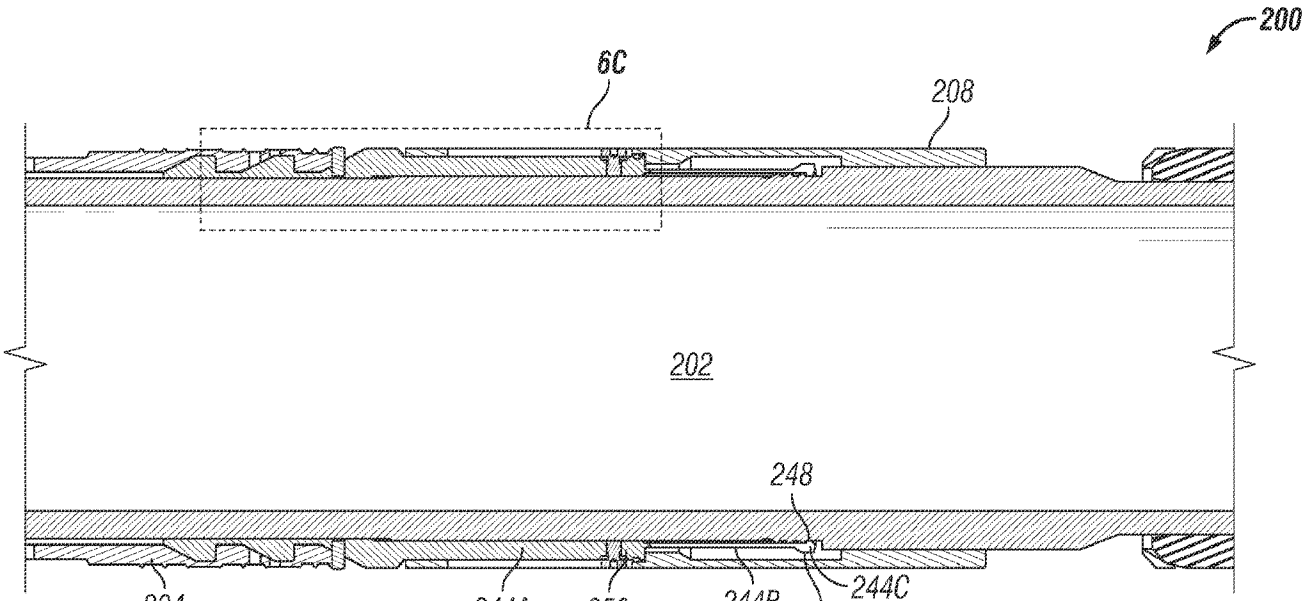
Figure 6C:
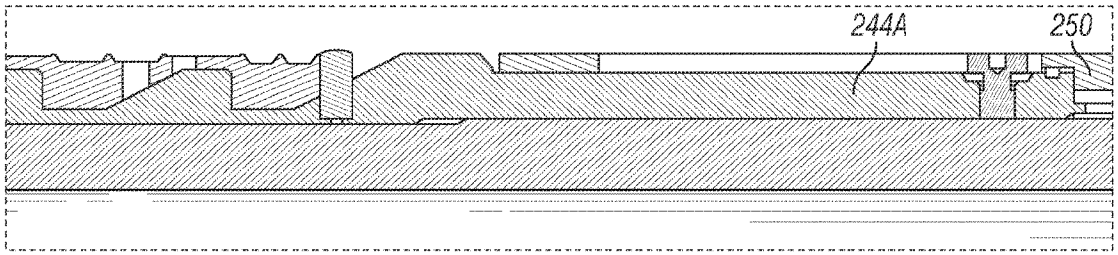

Referring now to FIGS. 6A and 6B, the packer assembly 200 is shown in a release position for retrieval from the wellbore 132. The retrieval operation may be initiated in a variety of ways. One way to initiate the retrieval operation is by running a cutting tool (not shown) downhole and cutting the mandrel 202, which may allow the cover sleeve 208 and collet member 244A to move downhole. This allows the mandrel 202 to be pulled uphole, which allows the slip assembly 204 to return to a smaller outer diameter. Specifically, the downward movement of the collet member 244A may cause the slip assembly 204 to release from its gripping relationship with the well casing 134. As the collet member 244A moves downhole, the inner surface 248 of collet lugs 244C may engage a protrusion 228 on the outer surface of the mandrel 202. The collet lugs 244C may remain engaged with the protrusion 228 of the mandrel 202 as the packer assembly 200 is retrieved from the wellbore 132, thus preventing the slip assembly 204 from inadvertently re-actuating. FIG. 6C shows a close-up view of the collet member 244A and the snap ring 250.

One embodiment is an apparatus that includes a mandrel comprising an outer surface with a protrusion and a depression, a slip assembly disposed about the mandrel, a collet member disposed about the mandrel and disposed adjacent to the slip assembly, wherein the collet member includes a collet lug comprising a tapered inner surface and a tapered outer surface and wherein the collet member is selectively moveable to run, set, and release positions along the length of the mandrel; and a cover sleeve disposed about the mandrel and coupled to the collet member.

Optionally, the collet lug inner surface may be operable to selectively engage the depression when the collet member is in the run position.

Optionally, the cover sleeve may be operable to release the collet lug from the depression.

Optionally, the collet lug inner surface may be operable to selectively engage the protrusion when the collet member is in the release position.

Optionally, the slip assembly may be located uphole of the collet member and the cover sleeve.

Optionally, the apparatus may be operable to be deployed to a downhole location and retrieved from a downhole location.

Optionally, the collet member may be operable to extend radially when disengaged from the mandrel.

Optionally, the slip assembly may be operable to move radially outward about the mandrel.

Optionally, the slip assembly may be operable to engage a well casing when the collet member is in the set position.

Another embodiment is a method for releasing a packer assembly, including cutting a mandrel, wherein the mandrel includes an outer surface with a protrusion and a depression, sliding a cover sleeve and a collet member having a collet lug downhole with respect to the mandrel, applying force from the collet member to the slip assembly, disengaging the slip assembly from a well casing, and engaging an inner surface of the collet lug to the protrusions.

Optionally, the slip assembly may be located uphole of the collet member and the cover sleeve.

Optionally, the collet lug may include a tapered inner surface.

Optionally, the collet lug may include a tapered outer surface.

Optionally, the method may include preventing the collet member from extending radially.

Optionally, the method may include preventing the slip assembly from re-actuating.

Another embodiment is a method for running a packer assembly downhole including coupling a collet member to a cover sleeve, wherein the collet member includes a collet lug having a tapered inner surface, engaging the inner surface of the collet lug to an outer surface of a mandrel, wherein the outer surface of the mandrel includes a protrusion and a depression, and deploying the collet member, the cover sleeve, the mandrel, and a slip assembly to a downhole location.

Optionally, the slip assembly may be located uphole of the collet member and the cover sleeve.

Optionally, the collet lug may include a tapered outer surface.

Optionally, the method may include preventing the collet member from extending radially.

Optionally, the method may include preventing the slip assembly from actuating prematurely.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. An apparatus comprising:

a mandrel comprising an outer surface with a protrusion and a depression;

a slip assembly disposed about the mandrel;

a collet member disposed about the mandrel and disposed adjacent to the slip assembly, wherein the collet member comprises a collet lug comprising a tapered inner surface and a tapered outer surface, and wherein the collet member is selectively moveable to run, set, and release positions along the length of the mandrel, wherein the collet lug inner surface engages the depression of the mandrel when the collet member is in the run position; and a cover sleeve disposed about the mandrel and coupled to the collet member.

2. The apparatus of claim 1, wherein the cover sleeve is operable to release the collet lug from the depression.

3. The apparatus of claim 1, wherein the collet lug inner surface is operable to selectively engage the protrusion when the collet member is in the release position.

4. The apparatus of claim 1, wherein the apparatus is operable to be deployed to a downhole location and retrieved from a downhole location.

5. The apparatus of claim 1, wherein the collet member is operable to extend radially when disengaged from the mandrel.

6. The apparatus of claim 1, wherein the slip assembly is operable to move radially outward about the mandrel.

7. The apparatus of claim 6, wherein the slip assembly is operable to engage a well casing when the collet member is in the set position.

8. The apparatus of claim 1, wherein the slip assembly is located uphole of the collet member and the cover sleeve.

9. A method for releasing a packer assembly comprising:

cutting a mandrel, wherein the mandrel comprises an outer surface with a protrusion and a depression;

sliding a cover sleeve and a collet member having a collet lug downhole with respect to the mandrel;

applying force from the collet member to the slip assembly;

disengaging the slip assembly from a well casing; and engaging an inner surface of the collet lug to the protrusions.

10. The method of claim 9, wherein the slip assembly is located uphole of the collet member and the cover sleeve.

11. The method of claim 9, wherein the collet lug inner surface is a tapered surface.

12. The method of claim 11, wherein the collet lug comprises a tapered outer surface.

13. The method of claim 9, further comprising:

preventing the collet member from extending radially.

14. The method of claim 9, further comprising:

preventing the slip assembly from re-actuating.

15. A method for running a packer assembly downhole comprising:

coupling a collet member to a cover sleeve, wherein the collet member is selectively movable to run, set, and release positions along the length of the mandrel, and wherein the collet member comprises a collet lug having a tapered inner surface;

engaging the inner surface of the collet lug to an outer surface of a mandrel in the run position, wherein the outer surface of the mandrel comprises a protrusion and a depression; and deploying the collet member, the cover sleeve, the mandrel, and a slip assembly to a downhole location.

16. The method of claim 15, wherein the collet lug comprises a tapered outer surface.

17. The method of claim 15, further comprising:

preventing the collet member from extending radially.

18. The method of claim 15, further comprising:

preventing the slip assembly from actuating prematurely.

19. The method of claim 15, wherein the slip assembly is located uphole of the collet member and the cover sleeve.

* * * * *